US008881863B2

(12) United States Patent
Abram et al.

(10) Patent No.: US 8,881,863 B2
(45) Date of Patent: Nov. 11, 2014

(54) EXHAUST GAS CARRYING COMPONENT OF AN EXHAUST GAS SYSTEM

(71) Applicant: Faurecia Emissions Control Technologies, Germany GmbH, Augsburg (DE)

(72) Inventors: Kwin Abram, Columbus, IN (US); Dennis Boennen, Bobingen (DE)

(73) Assignee: Emcon Technologies Germany (Augsburg) GmbH, Augsburg (DE)

( * ) Notice: Subject to any disclaimer, the term of this patent is extended or adjusted under 35 U.S.C. 154(b) by 0 days.

(21) Appl. No.: 13/939,562

(22) Filed: Jul. 11, 2013

(65) Prior Publication Data

US 2014/0027198 A1 Jan. 30, 2014

(30) Foreign Application Priority Data

Jul. 24, 2012 (DE) ..... 10 2012 014 620

(51) Int. Cl.
*F01N 1/00* (2006.01)

(52) U.S. Cl.
USPC ..... 181/247; 181/212

(58) Field of Classification Search
USPC ..... 181/247, 212
See application file for complete search history.

(56) References Cited

U.S. PATENT DOCUMENTS

| | | | | |
|---|---|---|---|---|
| 7,958,966 | B2 * | 6/2011 | Smith | 181/264 |
| 7,971,681 | B2 * | 7/2011 | Bohnaker et al. | 181/240 |
| 8,550,122 | B2 * | 10/2013 | Derry et al. | 138/108 |
| 8,550,208 | B1 * | 10/2013 | Potokar | 181/212 |
| 2008/0035421 | A1 * | 2/2008 | Feist et al. | 181/212 |

FOREIGN PATENT DOCUMENTS

| | | | |
|---|---|---|---|
| CN | 2918745 | Y | 7/2007 |
| DE | 103 37 110 | A1 | 3/2005 |
| DE | 10 2011 011 060 | A1 | 8/2012 |
| EP | 2017440 | A1 | 1/2009 |

OTHER PUBLICATIONS

DE Search Report dated Dec. 10, 2012.

* cited by examiner

*Primary Examiner* — Forrest M Phillips
(74) *Attorney, Agent, or Firm* — Carlson, Gaskey & Olds, PC

(57) ABSTRACT

An exhaust gas carrying of an exhaust gas system of a combustion engine fulfills a sound-absorbing function and has an outer shell that comprises at least one sound-absorbing portion. The sound-absorbing portion is provided with micro perforations which have a sound-absorbing effect and through which exhaust gas is directly discharged to an external environment.

19 Claims, 2 Drawing Sheets

EXHAUST GAS CARRYING COMPONENT OF AN EXHAUST GAS SYSTEM

CROSS-REFERENCE TO RELATED APPLICATION

This application claims priority to German Application No. 102012014620.5, which was filed Jul. 24, 2012.

TECHNICAL FIELD

The invention relates to an exhaust gas carrying component of an exhaust gas system, in particular for a combustion engine of a motor vehicle.

BACKGROUND

It is known to insert exhaust gas mufflers in the exhaust gas stream of an exhaust gas system, which reduce the sound emission into the environment of the vehicle. In said mufflers, sound-absorbing fiber mats or metal sheets are arranged in an outer, gas-tight housing to damp the sound emission by absorption or specific reflection. It is also known to insert tubes or metal sheets comprising micro perforations for sound attenuation in the interior of such an exhaust gas muffler.

CN 202451243 shows a muffler in which a tail pipe is provided with a plurality of relatively large openings which connect the interior of the muffler to the environment. The diameter of the openings is between 1.5 and 5 mm.

It is the objective of the invention to provide a simply constructed but nevertheless effective means of sound attenuation for an exhaust gas system of a combustion engine.

SUMMARY

An exhaust gas carrying component of an exhaust gas system of a combustion engine fulfills a sound-absorbing function and has an outer shell fitted with at least one sound-absorbing portion provided with micro perforations which have a sound-absorbing effect and through which the exhaust gas is directly discharged to the environment. With the invention, the concept of a gas-tight outer shell is abandoned. On the contrary, openings are specifically produced in the exhaust gas carrying component which lead to the environment of the exhaust gas system, i.e. in the case of a vehicle directly into the environment of the vehicle, so that the exhaust gas quickly escapes to the outside through the outer shell.

Micro perforations are openings with a cross-sectional area of at most 2 $mm^2$, in particular not larger than only 0.5 $mm^2$.

Any gas escaping through the micro perforations leaves the entire exhaust gas system and does not only enter, e.g., an intermediate space between two exhaust gas carrying pipe portions of an exhaust gas line.

At least a part of the exhaust gas leaves the exhaust gas system through the micro perforations. The exhaust gas carrying component or the exhaust gas system may be designed such that the exhaust gas escapes to the environment exclusively through the micro perforations.

In the region of the micro-perforated portion, turbulent flows in the exhaust gas flow are attenuated and converted into laminar flows. This will reduce the amount of high frequencies in the frequency spectrum. It has become apparent that low frequencies are likewise attenuated by the presence of the micro perforations. Using a micro-perforated pipe, for instance, ensures that there are fewer resonances due to standing waves.

In this context, the term "portion which is provided with micro perforations" is to be understood as a region of the outer shell which comprises a plurality of neighboring, small and penetrating openings.

It is preferred that the outer shell delimits the exhaust gas carrying component with respect to the environment, i.e. defines the outermost barrier between the exhaust gas and the environment of the exhaust gas system or of the vehicle. The inner side of the outer shell is in direct contact with the exhaust gas which may directly flow along the inner side of the outer shell.

The exhaust gas carrying component may be made entirely of a micro-perforated metal sheet or only in sections.

It is possible to design the outer shell completely as a sound-absorbing portion; in this case, the entire outer shell of the component is provided with micro perforations.

It is also conceivable, however, that one or more portions of the component are realized to be gas-tight and only one or more portions of any desired size are provided with micro perforations.

The outer shell extends circumferentially around the component and the sound-absorbing portion may extend only over a part of the circumference and/or only over an axial portion of the outer shell.

The total surface area of the micro perforations may amount to approximately 1-10%, in particular preferably 1-3% of the total surface area of the sound-absorbing portion (perforation degree). Here, the term "total surface area of the sound-absorbing portion" is to be understood as the immediate region which is provided with micro perforations.

The pore size of the individual micro perforations is preferably between approximately 0.02 and 2.0 $mm^2$, in particular preferably between 0.04 and 1.0 $mm^2$.

The individual micro perforations may be circular, but also oval or slit-shaped, for example. If slits are used, a slit width may lie between 0.01 and 0.15 mm, for instance, in particular between 0.01 and 0.1 mm, while the slit length may amount to approximately 0.5 to 2.5 mm.

The exhaust gas carrying component may be a muffler, for instance, as it is installed in vehicles in the end region of known exhaust gas systems.

It is also possible to realize the exhaust gas carrying component as a tail pipe of the exhaust gas system.

In one example, the sound-absorbing exhaust gas carrying component preferably does without any sound-damping materials such as fiber mats in the interior of the component and may be free of any sound-absorbing matter.

Exhaust gas guiding elements, such as metal sheets which may also comprise micro perforations, may be provided in the interior of the exhaust gas carrying component. The use of such exhaust gas guiding elements is especially advantageous if the component is a muffler box.

It is possible to design a downstream free end of the exhaust gas carrying component to be closed. A sound-absorbing portion may be provided in the region of the free end.

In a preferred embodiment, the free end of the component is closed by an end wall, and a sound-absorbing portion can be formed in the region of the free end.

To give an example, the end wall may be entirely designed as a sound-absorbing portion comprising micro perforations. It is also possible, however, to realize the end wall to be closed and gas-tight and to provide micro perforations at least in sections of the circumferential area of the tail pipe adjoining the end wall. Thus, the term "closed" also comprises that micro perforations are provided in the end wall.

Here, the component may be realized as a tail pipe or as a muffler.

According to a further embodiment, a cowling part is provided circumferentially surrounding a tail pipe, comprising the sound-absorbing portion, in the region of the free end and having a downstream free open end. Such exhaust designs are sometimes referred to as a "bean can," where a cowling surrounds the tail pipe at a distance. The cowling part is placed on the tail pipe, but for its part is not an exhaust gas carrying or sound-absorbing element of the exhaust gas system and has no micro perforations.

The cowling part may extend somewhat beyond the free end of the tail pipe. It is preferred that the diameter of the cowling part is not reduced towards the free end, but rather is flared.

Optionally, the diameter of the component in the transition area to the sound-absorbing component changes; the component is flared, for instance. In particular, the component comprises a widened portion directly at the exhaust gas inlet so that the component comprises a chamber and a feed pipe which opens into the chamber of enlarged cross-section and the outer shell of the chamber forms the sound-absorbing portion at least in sections.

If it is required to control the exhaust gas pressure in the exhaust gas carrying component, e.g. a valve is arranged in front of or behind the exhaust gas carrying component, through which the flow cross-section of the exhaust gas line can be completely or partially closed. In this way, the exhaust gas flow through the exhaust gas carrying component and hence the internal pressure in the exhaust gas carrying component is controlled depending on the situation so that the pressure conditions which are required for the escape of the exhaust gas through the micro perforations will always be created.

Enhancing the internal pressure, for example, increases the dissipation of energy by the micro perforations and thus reduces sound energy.

These and other features may be best understood from the following drawings and specification.

BRIEF DESCRIPTION OF THE DRAWINGS

The invention will be explained in the following in more detail with the aid of several example embodiments and with respect to the attached drawings. In all Figures, the respective exhaust gas carrying component is shown in a very schematic illustration. In the Figures.

DETAILED DESCRIPTION

Figure 1:
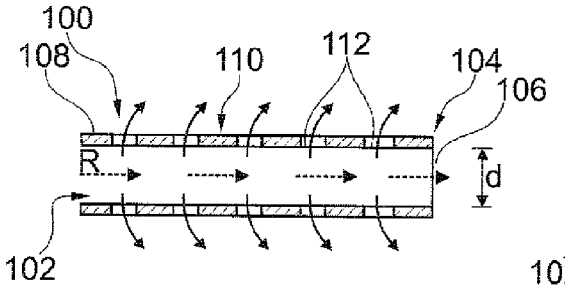
FIG. 1 shows an exhaust gas carrying component according to the invention in the form of a tail pipe which is open at the front end.

FIG. 1 shows an exhaust gas carrying component 100 of an exhaust gas system (not shown in greater detail) of a vehicular combustion engine, here designed as the tail pipe of the exhaust gas system.

The tubular exhaust gas carrying component 100 has one end connected to an exhaust gas line of the combustion engine via an exhaust gas inlet 102 and represents its last portion, i.e. the component 100 discharges the exhaust gas into the environment of the exhaust gas system or of the vehicle.

The opposite, second end of the exhaust gas carrying component 100 forms an exhaust gas outlet 104. In this case, the exhaust gas outlet 104 is formed by the open end wall 106 of the component 100.

The diameter d (measured internally) of the exhaust gas carrying component 100 remains unchanged along its entire extension.

The entire outer shell 108 of the component 100 forms a sound-absorbing portion 110 and is provided with a large number of micro perforations 112 which are uniformly distributed over the axial extension and the circumference of the outer shell 108. Here, all the openings in the circumferential surface of the outer shell 108, which are indicated in a very schematic manner and to be exaggerated in size, represent micro perforations 112.

The outer shell 108 including the sound-absorbing portion 110 entirely consists of a metal sheet, preferably an aluminum or stainless steel sheet.

Exhaust gas escapes through the micro perforations 112 from the exhaust gas system directly into in the environment of the exhaust gas system, as well as through the open end wall 106 of the component 100.

The individual micro perforations 112 are preferably formed to be slit-shaped; the slit width may be approximately 0.05 mm and the slit length may amount to approximately 1.5 mm. This results in an approximate surface area for the individual micro perforations of around 0.075 $mm^2$.

It goes without saying that the individual micro perforations 112 may also be circular, oval or trapezoidal or have any other suitable shape. It is also possible to combine different cross-sectional shapes.

The density and size of the micro perforations are selected here such that around 1 to 3% of the total surface area of the sound-absorbing portion 110 is defined by the micro perforations 112. The density of the micro perforations 112 in the sound-absorbing portion 110 may be the same all over the entire sound-absorbing portion 110, but it may also vary in the flow direction R of the exhaust gas or in the circumferential direction.

The size and the total surface area of the micro perforations 112 are always to be selected such that the pressure in the exhaust gas system is ideal with respect to the operation of the combustion engine, as well as for the purpose of reducing the sound emission.

In the following, essentially identical components will be provided with the already assigned reference numerals.

Figure 2:
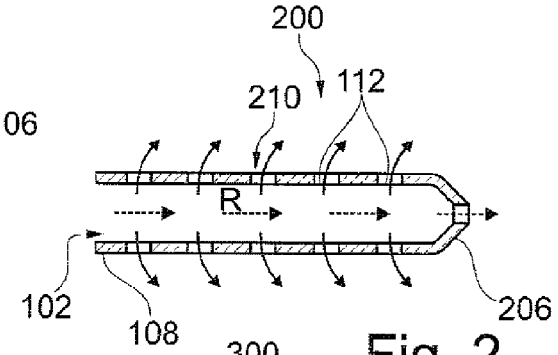
FIG. 2 shows an exhaust gas carrying component according to the invention in the form of a tail pipe which is closed at the front end.

FIG. 2 illustrates a second embodiment of an exhaust gas carrying component 200. Similar to the embodiment which has just been described, the exhaust gas carrying component 200 is realized as a tail pipe.

Other than the first embodiment, the side which is not connected to the exhaust gas system and is opposite the exhaust gas inlet 102, is closed by an end wall 206 conically tapering towards the outside. The entire exhaust gas carrying component 200, namely the outer shell 208 as well as the end wall 206 form the sound-absorbing portion 210 and entirely consist of a metal sheet comprising micro perforations 112.

The end wall 206 can be manufactured, for instance, by crimping or sectionally forming the end of the component 200. It is preferably formed to be conical, but may also have another shape.

In this embodiment, all the exhaust gas exits through the micro perforations 112. In this case, the exhaust gas outlet is formed by the entire sound-absorbing portion 210.

Figure 3:
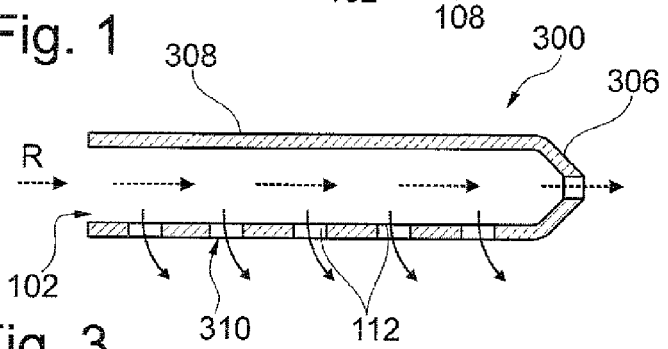
FIG. 3 shows an exhaust gas carrying component according to the invention in the form of a tail pipe which is closed at the front end and is provided with micro perforations only in sections.

FIG. 3 shows a third embodiment of an exhaust gas carrying component 300. Unlike the components just described, a part of the outer circumference of the outer shell 308 in axial and in circumferential directions, as well as a part of the conical end wall 306, are formed to be impermeable to gas, and only a portion of the outer circumference of the outer shell 308, as well as a portion of the end wall 306, are realized as a sound-absorbing portion 310 comprising micro perforations 112.

Here too, the exhaust gas outlet is formed by the entire sound-absorbing portion 310, and the whole exhaust gas leaves the exhaust gas system through the micro perforations 112.

It would be possible to realize the end wall 306 in such a manner that it is completely impermeable to gas. It would also be conceivable, however, to completely design it as a sound-absorbing portion comprising micro perforations 112.

Figure 4:
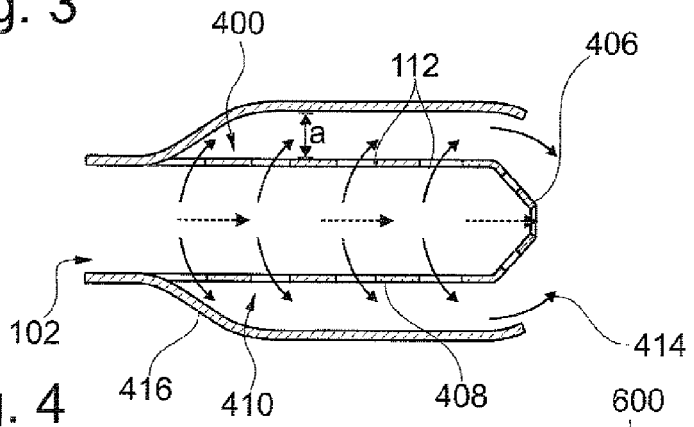
FIG. 4 shows an exhaust gas carrying component according to the invention comprising a cowling part for the formation of a muffler box.

FIG. 4 shows a fourth embodiment of an exhaust gas carrying component 400, which, analogous to the component 200 illustrated in FIG. 2, is tubular, comprises a closed end wall 406 and fully consists of a sound-absorbing portion 410 comprising micro perforations 112.

The component 400, here a muffler box which also serves as a tail pipe, is circumferentially surrounded by a gas-tight cowling part 416 which is open at its front, downstream end 414. The distance a between the outer shell 408 of the sound-absorbing portion 410 and the inner side of the cowling part 416 amounts to several millimeters here.

At the exhaust gas inlet 102, the cowling part 416 is connected to the outer shell 408 of the exhaust gas carrying component 400. The exhaust gas flows out from the exhaust gas carrying component 400 through the micro perforations 112 and along the cowling part 416 into the environment. The cowling part 416 itself does not comprise any micro perforations 112.

Here, the diameter of the cowling part 416 remains unchanged along the extension of the exhaust gas carrying component 400 so that the distance a does not vary significantly over the length of the component 400; this, however, is not to be understood as limiting.

Such a cowling part 416 may be provided for any other exhaust gas carrying component which is described herein. Due to the large distance a to the exhaust gas carrying component, the cowling part 416 does not form an obstacle for the exhaust gas flow, and the exhaust gas is directly discharged to the environment of the vehicle.

Figure 5:
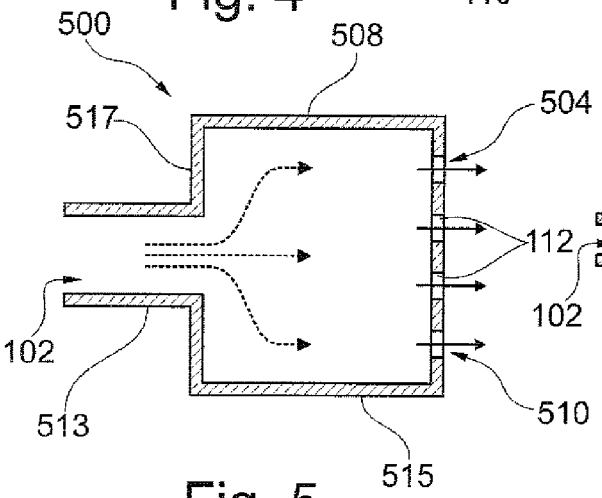
FIG. 5 shows an exhaust gas carrying component according to the invention in the form of a muffler box which is closed on the front end by a micro-perforated portion.

FIG. 5 shows a further embodiment of an exhaust gas carrying component 500. In this case, too, the exhaust gas carrying component 500 is realized as a muffler box and simultaneously forms the tail pipe of the exhaust gas system. Here, the exhaust gas carrying component 500 is realized as a wrap-type muffler comprising a wrapped outer shell 508 and an end wall 506 closing the outer shell 508 and forming an end bottom.

The exhaust gas inlet 102 realized as a feed pipe 513 is adjoined by a chamber 515 which has a significantly larger diameter than the feed pipe 513. The outer shell 508 of the chamber 515 is impermeable to gas in this example.

The exhaust gas outlet 504 is formed by the planar, closed end wall 506 of the chamber 515 which is opposite the exhaust gas inlet 102 and entirely formed as a sound-absorbing portion 510. In this example, all the exhaust gas flowing into the component 500 leaves the latter and the entire exhaust gas system through the micro perforations 112 in the end wall 506.

Alternatively or in addition, it would also be possible to provide a cut-out in the outer shell 508, said cut-out being covered with a metal sheet portion which is internally or externally fastened to the outer shell 508 and comprises micro perforations.

The end wall 506 and the wall 517 of the chamber 515 opposite thereto, through which the feed pipe 513 extends, are aligned to be parallel to each other and extend at right angles relative to the feed pipe 513.

Figure 6:
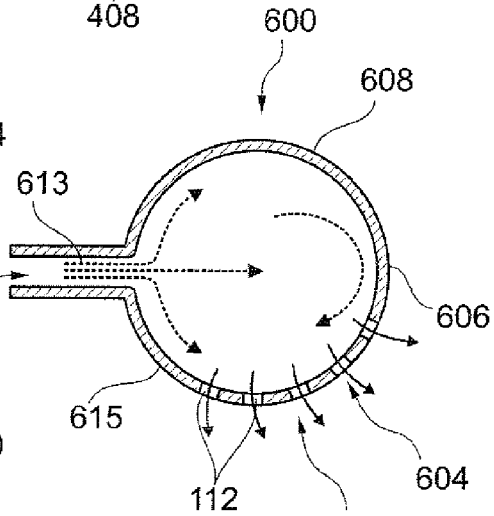
FIG. 6 shows an exhaust gas carrying component according to the invention in the form of a muffler box comprising a micro-perforated portion.

FIG. 6 shows a further embodiment Like the component 500 which has just been described, the exhaust gas carrying component 600 illustrated here is realized as a muffler box and at the same time forms the tail pipe of the exhaust gas system.

While the chamber 515 of the component 500 has a cylindrical shape and the end wall 506 is a planar wall, the component 600 flares in balloon-like fashion from the feed pipe 613 to a chamber 615. The end wall 606 of the chamber 615, terminating the component 600, also has a curved extension. Here, the exhaust gas carrying component 600 is realized as a shell-type muffler, and the chamber 615 is formed by two shells which are connected to each other. Micro perforations 112 may be provided in one or both shells.

In a portion which is not immediately opposite the feed pipe 613, the bulged outer shell 608 as sound-absorbing portion 610 is equipped with a number of micro perforations 112. Here too, all the exhaust gas leaves the exhaust gas system exclusively through the micro perforations 112 of the sound-absorbing portion 610.

Both the chamber 515 and the chamber 615 abruptly flare downstream of the feed pipe 513, 613, likewise resulting in a sound attenuation effect in the inflowing exhaust gas.

Figure 7:
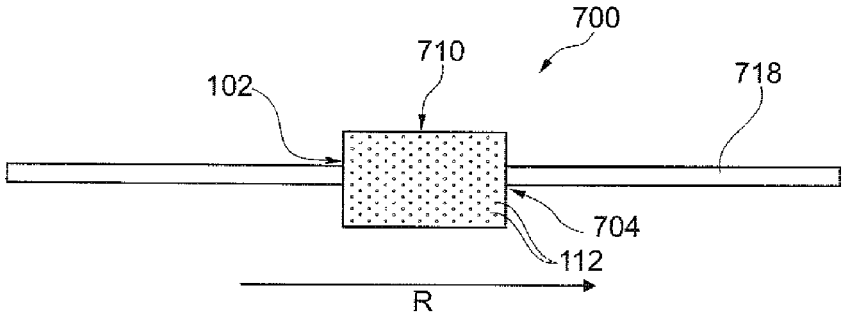
FIG. 7 shows an exhaust gas system comprising an exhaust gas carrying component according to the invention in the form of a muffler box.

In the embodiment shown in FIG. 7, the exhaust gas carrying component 700 is realized as an interposed, cylindrical muffler box and comprises an exhaust gas inlet 102 at one front end as well as an exhaust gas outlet 704 at the opposite front end, with the exhaust gas inlet 102 being connected to a feed line for exhaust gas from the exhaust gas system and the exhaust gas outlet 104 being connected to a conventional tail pipe 718.

The entire outer shell of the component 700 forms a sound-absorbing portion 110 and is provided with micro perforations 112.

A part of the exhaust gas leaves the exhaust gas system through the micro perforations 112, whereas the residual proportion of the exhaust gas flows off through the tail pipe 718 into the environment.

Figure 8:
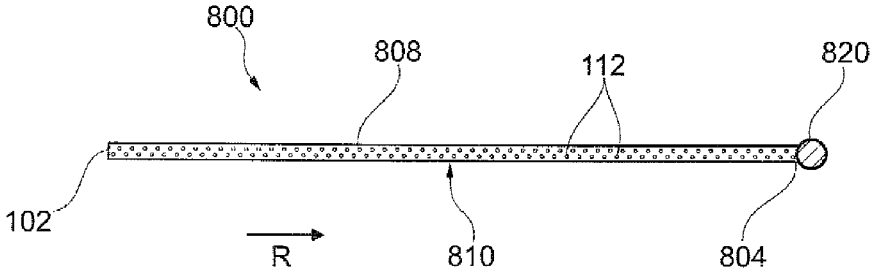
FIG. 8 shows an exhaust gas carrying component according to the invention in the form of a tail pipe which has its front end closed by a valve.

FIG. 8 illustrates an exhaust gas carrying component 800 in the form of a tail pipe which is realized along the entire length of its outer shell 808 as a sound-absorbing portion 810 comprising micro perforations 112. Here, the micro perforations 112 are arranged along the entire length and over the entire circumference of the sound-absorbing portion 810.

The exhaust gas outlet 804, which in itself has an open front end and is opposite the exhaust gas inlet 102, can be closed or unblocked by a valve 820 in a situation-dependent manner. In this way, the internal pressure in the exhaust gas carrying component 800 can be adjusted to suitable and desired values. An increased internal pressure may enhance a dissipation of energy by the micro perforations 112 and thus contribute to the reduction of the sound energy.

Figure 9:
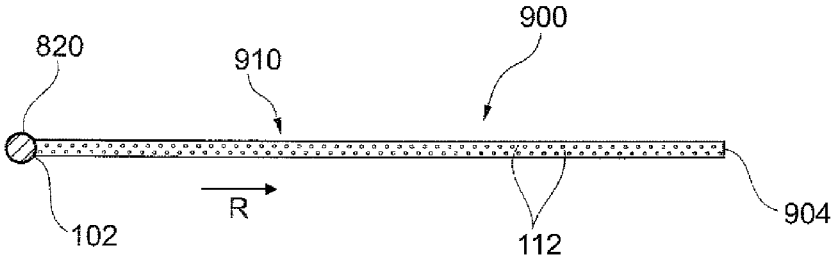
FIG. 9 shows an exhaust gas carrying component according to the invention in the form of a tail pipe which is provided with a valve.

In the exhaust gas carrying component 900 shown in FIG. 9, the valve 820 is arranged upstream of the sound-absorbing portion 910 on the exhaust gas inlet 102, in contrast to the embodiment just described.

The exhaust gas outlet 904 can either be realized as an open front end or may be completely or partially closed, for instance by a further sound-absorbing portion comprising micro perforations 112. In this case, too, the valve 820 allows the adjustment of the pressure and the exhaust gas flow through the component 900. The generation of standing waves can be reduced in this way, for example.

With the exhaust gas carrying components 800 or 900, it is also possible that only a part of the component is realized as a sound-absorbing portion 810, 910 comprising micro perforations 112.

Individual features of the described embodiments can be freely combined or interchanged at the discretion of a person skilled in the art.

Thus, it would be possible in all embodiments to install a valve at the exhaust gas outlet or at the exhaust gas inlet.

In all embodiments, the above-mentioned values regarding shape, area and distribution of the micro perforations can be used.

In the interior of the exhaust gas carrying component, deflection metal sheets (not illustrated) may be arranged for the purpose of a further sound attenuation, in particular if the exhaust gas carrying components are realized as mufflers. These may also be internally divided into several chambers. In all embodiments, however, the exhaust gas carrying component does not comprise any fibrous sound absorbing materials.

In any case, the exhaust gas flows through the sound-absorbing portion directly into the environment of the exhaust gas system or of the vehicle.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. An exhaust gas carrying component of an exhaust gas system of a combustion engine comprising:

an exhaust component extending from an upstream end to a downstream end, the upstream end being configured to receive engine exhaust gases from a vehicle combustion engine and with the engine exhaust gases being directed along an engine exhaust gas flow path to the downstream end, and the exhaust component fulfilling a sound-absorbing function and having an outer shell that comprises at least one sound-absorbing portion, which is provided with micro perforations which have a sound-absorbing effect and through which exhaust gas is directly discharged to an external environment, and wherein a pore size of the micro perforations always amounts to a size within a range of approximately 0.02 to 2.0 $mm^2$.

2. The exhaust gas carrying component according to claim 1, wherein the exhaust component is designed such that any gas exits exclusively through the micro perforations.

3. The exhaust gas carrying component according to claim 1, wherein the outer shell is entirely designed as the sound-absorbing portion.

4. The exhaust gas carrying component according to claim 1, wherein the outer shell extends circumferentially and the sound-absorbing portion extends only over a part of the circumference.

5. The exhaust gas carrying component according to claim 1, wherein the micro perforations make up approximately 1-10% of a total surface of the sound-absorbing portion.

6. The exhaust gas carrying component according to claim 1, wherein the exhaust component is a muffler.

7. The exhaust gas carrying component according to claim 1, wherein the exhaust component is a tail pipe.

8. The exhaust gas carrying component according to claim 1, wherein exhaust gas guiding elements are provided in an interior of the component.

9. The exhaust gas carrying component according to claim 1, wherein the downstream end of the exhaust component comprises a downstream free end which is closed, a sound-absorbing portion being provided in a region of the downstream free end.

10. The exhaust gas carrying component according to claim 9, wherein the downstream free end is closed by an end wall that is designed as the sound-absorbing portion.

11. The exhaust gas carrying component according to claim 1, wherein a cowling part is provided which circumferentially surrounds a tail pipe comprising the sound-absorbing portion in a region of a free end and comprises a downstream, open end.

12. The exhaust gas carrying component according to claim 1, wherein the exhaust component comprises a chamber and a feed pipe opening into the chamber which is enlarged in cross-section, the outer shell of the chamber at least partially forming the sound-absorbing portion.

13. The exhaust gas carrying component according to claim 1, wherein the micro perforations make up approximately 1-3% of a total surface of the sound-absorbing portion.

14. The exhaust gas carrying component according to claim 1, wherein the range is further defined as being approximately 0.04 to 1.0 $mm^2$.

15. The exhaust gas carrying component according to claim 1, wherein the exhaust gas component defines a portion of the engine exhaust gas flow path which extends generally in an axial direction from a vehicle exhaust system upstream end at the vehicle combustion engine to a vehicle exhaust system downstream end where the exhaust gases exit a tailpipe.

16. The exhaust gas carrying component according to claim 15, wherein the outer shell defines a center axis that defines the axial direction, and wherein at least a portion of the micro perforations are formed within the outer shell to be circumferentially spaced apart from each other about the center axis.

17. The exhaust gas carrying component according to claim 16, wherein the at least a portion of the micro perforations direct the exhaust gases in a direction having a radial component relative to the central axis.

18. The exhaust gas carrying component according to claim 15, wherein the downstream end of the exhaust component comprises an enclosed end face that includes micro perforations.

19. The exhaust gas carrying component according to claim 15, wherein the exhaust gas component comprises the tailpipe, and wherein all engine exhaust gases exit the vehicle exhaust system through the tailpipe to be directly discharged to the external environment.

* * * * *